US005913283A

United States Patent [19]

Coury

[11] Patent Number: 5,913,283

[45] Date of Patent: Jun. 22, 1999

[54] EQUESTRIAN BARRIER

[76] Inventor: Joseph S. Coury, Clear Spring Farms, RD #1, Sigel, Pa. 15860

[21] Appl. No.: 08/954,497

[22] Filed: Oct. 20, 1997

[51] Int. Cl.[6] ..... A01K 15/02

[52] U.S. Cl. ..... 119/705; 482/17

[58] Field of Search ..... 119/705; 482/17; 248/219.1, 219.3, 219.4

[56] References Cited

U.S. PATENT DOCUMENTS

| | | | |
|---|---|---|---|
| 2,989,309 | 6/1961 | Conrad | 119/705 X |
| 4,414,920 | 11/1983 | Richards et al. . | |
| 4,793,288 | 12/1988 | Hoadley . | |
| 4,827,873 | 5/1989 | Wong . | |
| 4,946,139 | 8/1990 | Tomellini | 256/64 |
| 4,989,821 | 2/1991 | Wong . | |
| 5,334,121 | 8/1994 | McPhilomy | 482/17 |
| 5,536,222 | 7/1996 | Banda et al. | 482/38 |
| 5,690,583 | 11/1997 | Keusch | 119/705 X |

FOREIGN PATENT DOCUMENTS

| | | | |
|---|---|---|---|
| 2388578 | 11/1978 | France | 119/705 |
| 2031154 | 12/1971 | Germany | 119/705 |
| 26 04 388 | 8/1977 | Germany . | |
| 2 268 411 | 1/1994 | United Kingdom . | |

*Primary Examiner*—Robert P. Swiatek

[57] ABSTRACT

An equestrian barrier having a standard, a jump cup that can be adjusted to various positions along the standard, and a pole supported by the jump cup. The standard has notches formed at intervals therein. Each notch is defined by a lower arcuate surface. An end of the jump cup has a corresponding curved surface. When the end of the jump cup is received in one of the notches, the pair of curved surfaces oppose each other and the torsional component of gravity tends to seat an upper surface of the jump cup against an upper surface of the notch. A bracket can be provided to increase stability by engaging a groove formed on an opposite side of the standard.

18 Claims, 5 Drawing Sheets

EQUESTRIAN BARRIER

BACKGROUND OF THE INVENTION

1. Field of the Invention

The invention relates to barriers for equestrian competition, training, and exhibitions. More specifically, the invention is an equestrian standard and jump cup that is easily and accurately adjustable along the standard.

2. Description of the Related Art

One aspect of equestrian competition and exhibition is jumping in which a horse and rider jump over an obstacle, often referred to as a "barrier". Often the barrier is constituted of a pair of upright stands, known as "standards", a pair of blocks, known as "jump cups", movably mounted on the standards, and a pole extending horizontally between the jump cups. The rider directs the horse to jump over the pole. In competition, scoring is based on the number of poles cleared by the horse, and the height at which the various poles are set. The height of the poles is frequently changed based on the different riders, different horses, and the particular competition or exhibition.

To provide flexibility, an equestrian barrier known as a "caveletti" has been developed. A caveletti can be oriented in different manners and stacked upon other cavelettis to present barriers of different heights. However, stacking can provide a very unstable arrangement. Also, when using cavelettis, several pieces must be transported to the site of the competition in order to provide a wide range of barrier heights.

There have been several attempts to provide an equestrian barrier that is easy to setup and adjust. For example, U.S. Pat. No. 4,414,920 discloses a rectangular block which can be stacked with other similar blocks to provide barrier supports of varying heights. However, this device inherently has the same limitations as a caveletti, i.e. low stability and many pieces. U.S. Pat. No. 2,989,309 discloses an equestrian standard having a supporting block that can be positioned and fixed at intervals along the standard to provide a barrier having variable height. The supporting block has a pivoting lever attached thereto which engagements with one of plural notches formed on an outer surface of the support while a flat surface of the block abuts a flat inner surface of the support. The lever has a release mechanism which permits movement of the block downward in the event that the horse fails to clear the barrier and falls downward on the bar. The release mechanism is incorporated in the lever and the block is free to move along the support absent the retaining function of the lever. For this reason, the adjustment of the jump cup is not always precise.

SUMMARY OF THE INVENTION

It is an object of the invention to overcome limitations of conventional equestrian barriers.

It is another object of the invention to permit a jump cup to be easily positioned and retained at various heights along and upright standard.

It is still a further object of the invention to position a jump cup at various positions along a standard in a reliable and precise manner.

It is yet another object of the invention to permit a standard and jump cup to be easily formed from recycled plastic.

To achieve these objects, a first aspect of the invention includes a standard having a post supported by a base. An inner side of the post has notches formed therein at predetermined intervals. The notches are defined by an upper notch surface that is substantially flat and by a lower notch surface that is arcuate, is concave upward, and has a substantially constant radius of curvature. A jump cup has a first end defined by upper and lower surfaces that correspond substantially to the upper and lower notch surfaces respectively. A second and of the jump cup has a support surface adapted to support a pole or the like. The first end of the jump cup is inserted into a desired one of the notches to be retained at a desired height along the standard.

A second aspect of the invention includes a standard having a post supported by a base. An outer side of the post has grooves formed therein at predetermined intervals. An inner side of the post has notches formed therein at predetermined intervals. The notches are defined by an upper notch surface that is substantially flat and by a lower notch surface that is arcuate, is concave upward, and has a substantially constant radius of curvature. A jump cup has a first end defined by upper and lower surfaces that correspond substantially to the upper and lower notch surfaces respectively. A second end of the jump cup has a support surface adapted to support a pole or the like. A bracket is pivotally mounted to the jump cup. The first and of the jump cup is inserted into a desired one of the notches to be retained at a desired height along the standard. The standard passes through an opening in the bracket and a portion of the bracket is received in one of the grooves to provide additional stability.

BRIEF DESCRIPTION OF THE DRAWING

The invention will be described through preferred embodiments illustrated in the drawing in which.

DETAILED DESCRIPTION OF THE PREFERRED EMBODIMENT

Figure 1:
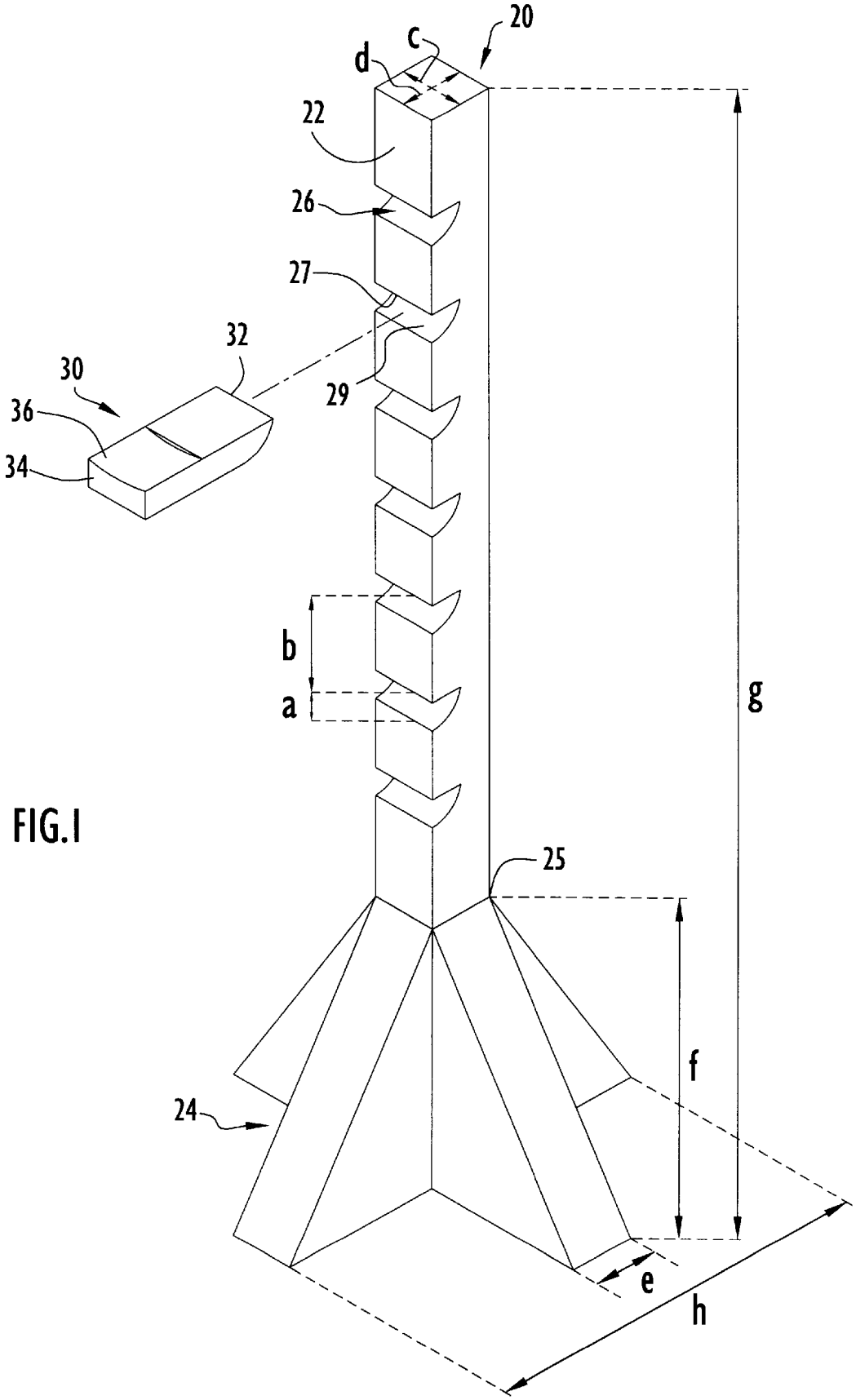
FIG. 1 is a perspective view of a standard and jump cup according to the invention.

FIG. 1 illustrates standard 20 and jump cup 30 in accordance with the invention. Standard 20 includes base 24 and upwardly extending post 22. Base 24 is constituted of a plurality, four in FIG. 1, of triangular blocks defining opening 25 in a top portion of base 24. Post 22 is received in opening 25 and secured therein through a pressure fit or by being seated on cross braces 21 (see FIG. 2) extending between the triangular blocks. Base 24 can be molded as a single piece, or as multiple pieces secured together with adhesive or the like, out of a resinous material made from recycled plastic or other materials. Further, post 22 can be made of similar materials and be formed integrally or separately from base 24.

A first surface, or inside surface, of post 22 has notches 26 (only one of which is indicated) formed therein at regular intervals. Notches 26 each are defined by upper surface 27 and lower surface 29. Upper surface 27 is substantially flat and preferably substantially perpendicular to a longitudinal, i.e. vertical, axis of post 22. Lower surface 29 is arcuate, extends from upper surface 27 to the inside surface, and preferably has a constant radius of curvature. The preferred dimensions of notches 26 are discussed in greater detail below.

Figure 2:
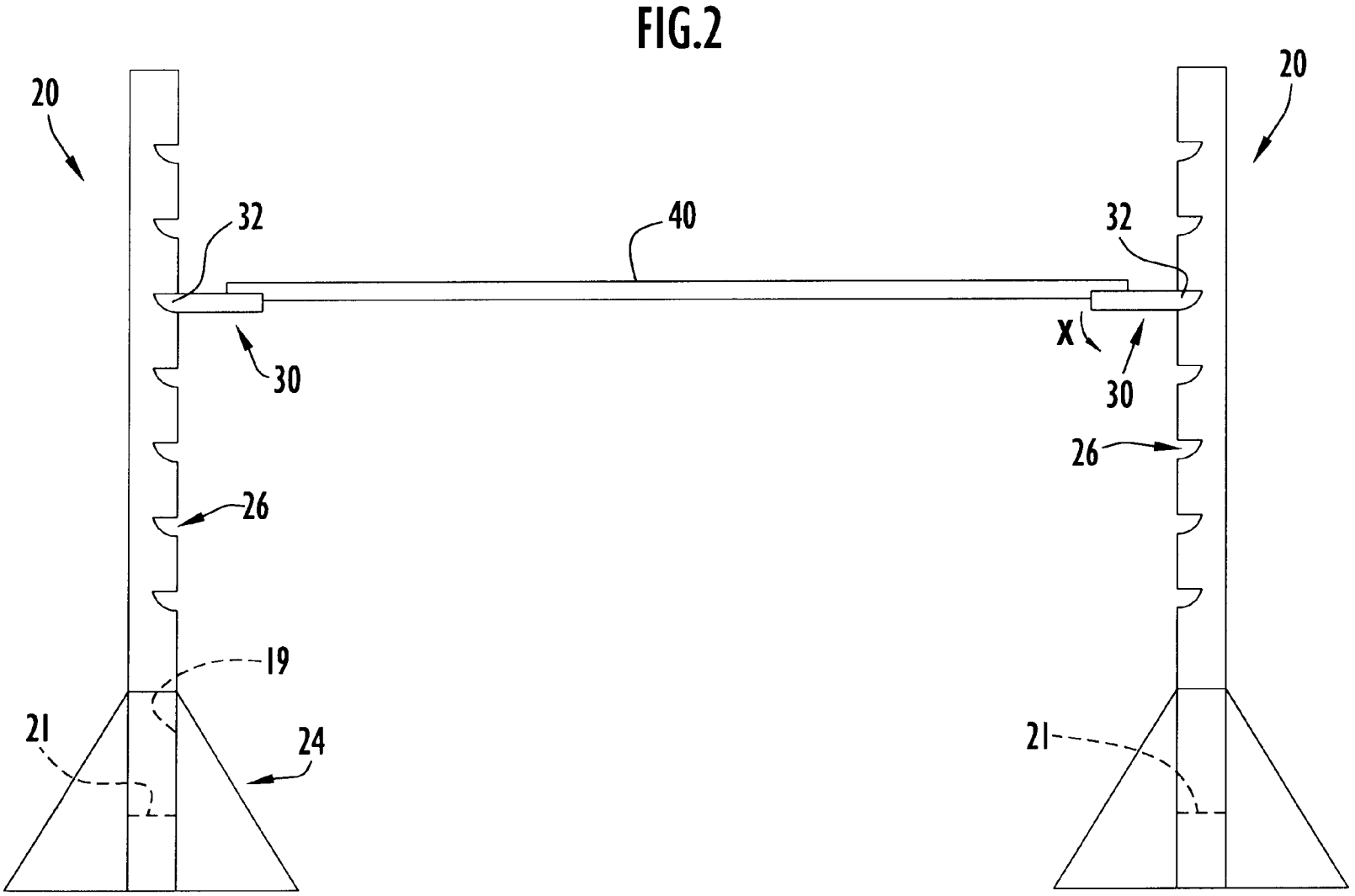
FIG. 2 is a side view of a barrier constituted of a pair of standards and jump cups of FIG. 1.

Jump cup 30 is essentially a block having first end 32 and second end 34. First end 32 has a curved lower surface which corresponds substantially with lower surface 29 of notches 26. Second end 34 has support area 36 defined thereon by an indentation, recess, or other configuration capable of supporting an end of bar 40 (see FIG. 2). First end 32 can be loosely fitted into any one of notches 26 to provide support for bar 40 as illustrated in FIG. 2. First end 32 is retained in notch 26 due to a torsional component of force due to gravity as indicated by arrow x. The configuration of notch 26 and first end 32 permits first end 32 to be easily inserted in notch 26, with virtually no frictional or other resistance, and retained in notch 26 by the torsional component of gravity which tends to cause the curved lower surface of first end 32 to slide upward along curved lower surface 29 of notch 26 thereby pressing a flat upper portion of first end 32 against upper surface 27 of notch 26.

FIG. 2 illustrates a barrier constituted of a pair of standards 20 and a corresponding pair of jump cups 30. As illustrated, standards 20 are placed in opposition to one another with the first surfaces, or inside surfaces, facing towards one another. In this position, jump cups 30 can be inserted into appropriate notches 26 depending on the desired height of the barrier. For example, notches 26 can be spaced apart by 6 inches to permit the barrier height to be adjusted in 6 inch intervals. Once jump cups 30 are inserted into notches 26, jump cups 30 are retained on standards 20 in the manner describe above. Bar 40 is then placed on jump cups 30 with respective ends of bar 40 resting on support areas 36 of jump cups 30.

It is apparent that the barrier can be easily set up and adjusted to a broad range of desired heights. Further, because jump cups 30 are pressed against upper surface 27 of notch 26, the height of jump cups 30, and thus the height of the barrier, is accurately maintained. Of course, plural pairs of standards 20 and jump cups 30 can be placed in series to support plural bars 40 to constitute a barrier having increased depth.

Applicant has found that particular dimensions of standard 20 and jump cup 30 yield optimal results. As illustrated in FIG. 1, the interval b between notches 26 is preferably 6 inches to permit the barrier height to be adjusted at 6 inch intervals. The radius of curvature of lower surface 29 of notch 26 is preferably between 1½ and 2½ inches and most preferably 2 inches. The height of each notch 26 relative to the bottom of base 24 is adjusted to yield barrier heights at even half foot intervals based on the depth of the recess defining support area 36, the thickness of bar 40, and other known variables. The distance a between upper surface 27 and lower surface 29, at the inside surface of post 22, is preferably 2 inches. The length c and width b of a cross section of post 22 are both preferably 4 inches. The width e of each triangular portion of base 24 is preferably 4 inches. The height f of each triangular portion of base 24 is preferably 16 inches. The height g of standard 20 in its entirety is typically about 66 inches. The length and width h of a bottom of base 24 is preferably 24 inches. The dimensions of first end 32 of jump cup 30 correspond substantially to the dimensions of notch 26, with adequate tolerance to permit easy insertion and removal of first end 32 into and from notch 26.

Figure 3:
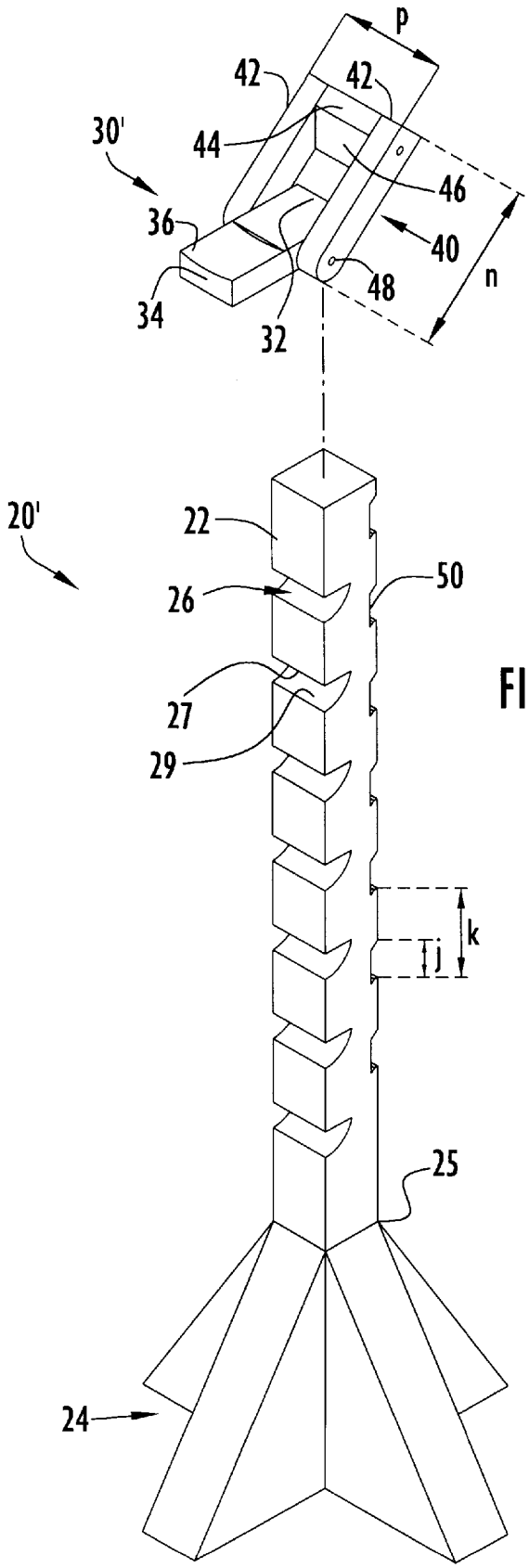
FIG. 3 is a perspective view of another standard and jump cup according to the invention.
Figure 4:
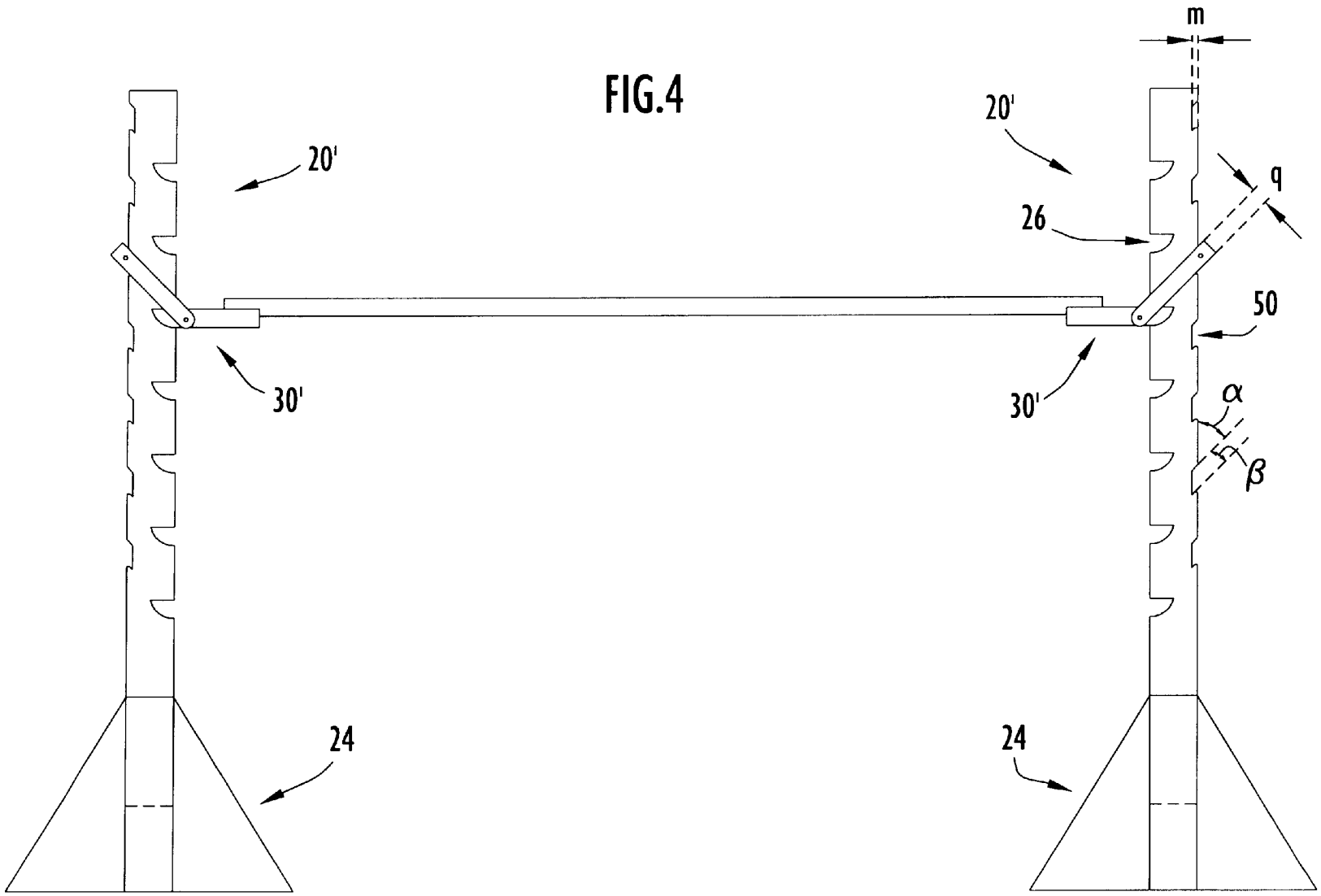
FIG. 4 is a side view of a barrier constituted of a pair of standards and jump cups of FIG. 3.

FIGS. 3 and 4 illustrate another standard 20' and jump cup 30' according to the invention. Many aspects of standard 20' and jump cup 30' are similar to standard 20 and jump cup 30 of FIGS. 1 and 2 and similar elements are labeled with the same reference numerals. A second surface, or outside surface, of post 22 has grooves 50 (only one of which is indicated) formed therein at regular intervals. The preferred configuration of grooves 50 is described in detail below.

Figure 5:
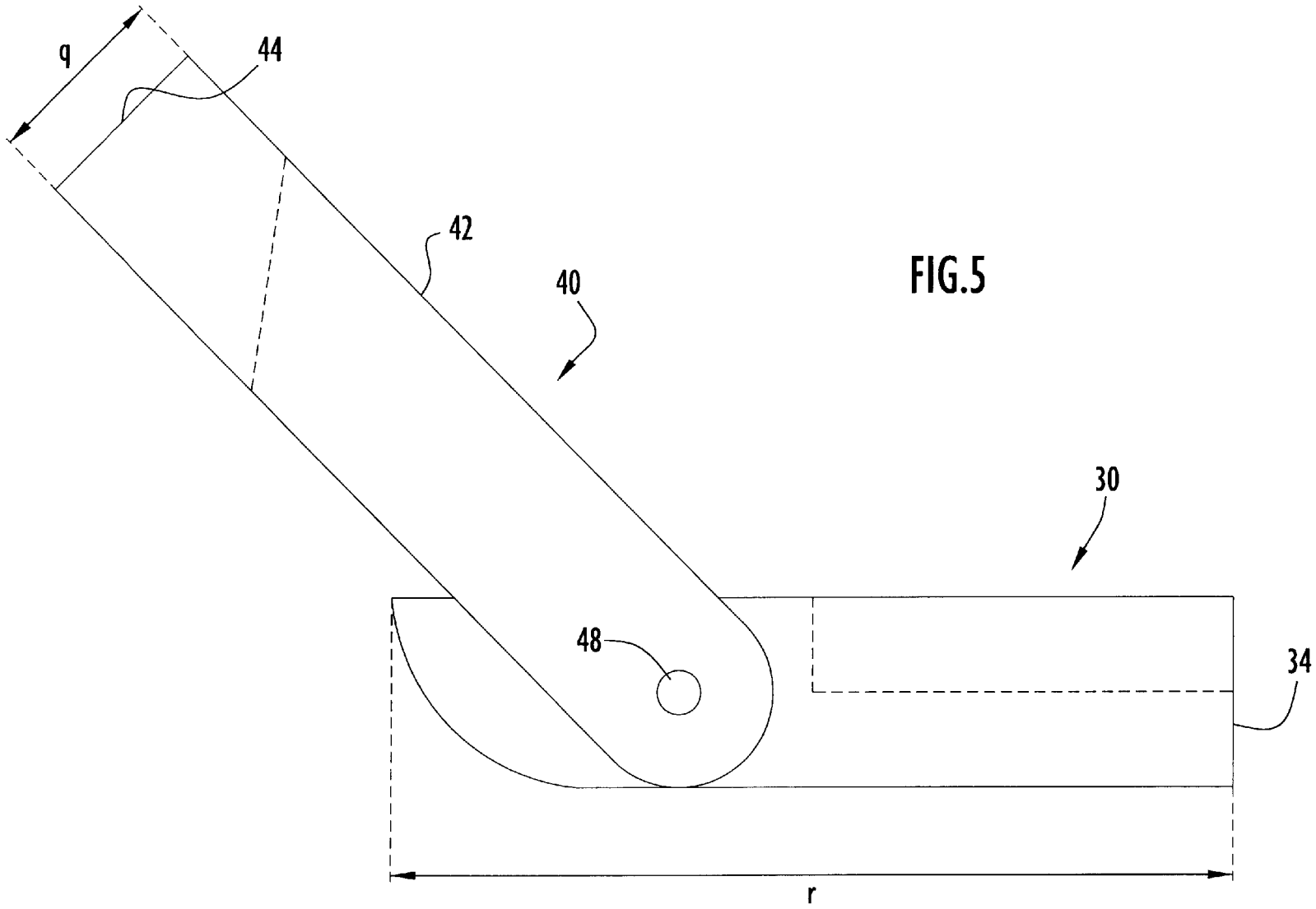
FIG. 5 is a side view of the jump cup of FIGS. 3 and 4.

Grooves 50 are defined in post 22 by upper and lower angled surfaces which each define about a 45° angle with respect to the other surface of post 22. Of course, this angle can be adjusted based on the dimensions of other elements described below. Bracket 40 is pivotally coupled to jump cup 30' at pivot point 48 (see FIG. 5). Bracket 40 is constituted of levers 42 which extend substantially in parallel to one another and cross member 44 connecting free ends of levers 42 to define an opening in bracket 40. Abutment surface 46 is defined on cross member 44 and extends at about a 45 degree angle with respect to longitudinal axes of levers 42.

FIG. 4 illustrates a barrier constituted of a pair of standards 20' and jump cups 30' having brackets 40. Each bracket 40 extends around post 22 with post 22 extending through the opening defined in bracket 40. Jump cup 30' can be pivoted upward to lie essentially parallel to post 22 to permit jump cup 30' and bracket 40 to be moved up or down along post 22. Jump cup 30' can then be pivoted to the position illustrated in FIG. 4 to be seated in an appropriate one of notches 26 while cross member 46 is seated in a groove 50 immediately above the notch 26. Bracket 40 provides additional stability to jump cup 30'.

Preferably grooves 50 are formed at interval k which is about 6 inches. Of course, interval k can be adjusted to correspond to the distance between notches 26. Preferably, the height j of grooves 50 is about 2 inches. The length n of levers 42 is preferably 9 inches and the length r of jump cup 30' is 7 inches. The height q of cross member 24 is preferably 2 inches. Of course, cross member 24 should be sized to be received in slot 50 with adequate tolerance.

The particular dimensions disclosed above are exemplary. However, these dimensions can be adjusted as desired and thus are not to be construed as limiting the scope of the invention. The invention can be formed of any suitable materials, such as recycled plastic, wood, metal, or the like. Further, multiple posts can be supported by a single base and can be fixed to the base or removable from the base.

The invention has been described through examples that are not intended to limit the scope of the invention as defined by the appended claims.

What is claimed:

1. An equestrian barrier capable of being adjusted to a plurality of heights comprising:

a pole;

a pair of standards each having a base and a post extending from said base, said post having notches formed on a first side thereof, each of said notches being defined by a substantially flat upper surface and a first lower arcuate surface that extends from the first side to the upper surface and is concave upward; and a pair of jump cups each having a first end configured to be received in one of said notches, said first end having a second lower arcuate surface that corresponds substantially to said first lower arcuate surface, said first lower arcuate surface opposing said second lower arcuate surface when said first end of said jump cup is received in a corresponding one of said notches, each of said jump cups also having a second end that is configured to support an end of said pole.

2. A barrier as recited in claim 1, wherein said first lower arcuate surface and said second lower arcuate surface define a radius of curvature in the range of 1.5 in. to 2.5 inches inclusive.

3. A barrier as recited in claim 1, wherein said first lower arcuate surface and said second lower arcuate surface define a radius of curvature of 2 in.

4. A barrier as recited in claim 1, wherein said base comprises plural triangular sections extending from a lower portion of said post.

5. A barrier as recited in claim 1, wherein plural grooves are defined in a second side of said post that is opposite said first side of said post, said barrier further comprising a bracket pivotally coupled to said jump cup and comprising a pair of levers extending in parallel to one another and a cross member connecting free ends of said levers to define an opening in said bracket, said cross member being configured to be received in one of said grooves when said first end of said jump cup is received in one of said notches.

6. A barrier as recited in claim 5, wherein said bracket extends at an angle of 45° with respect to said first side of said post when said cross member is received in said one of said grooves and said first end of said jump cup is received in said one of said notches.

7. A barrier as recited in claim 5, wherein said grooves are 2 inches high and 0.5 inches deep.

8. A barrier as recited in claim 1, wherein said notches are 2 inches high and 2 inches deep.

9. A barrier as recited in claim 1, wherein a cross section of said post is 4 inches wide and 4 inches high.

10. An equestrian standard and jump cup in combination in which said jump cup can be adjusted to a plurality of heights along said standard, said standard having a base and a post extending from said base, said post having notches formed on a first side thereof, each of said notches being defined by a substantially flat upper surface and a first lower arcuate surface that extends from the first side to the upper surface and is concave upward, said jump cup having a first end configured to be received in one of said notches, said first end having a second lower arcuate surface that corresponds substantially to said first lower arcuate surface, said first lower arcuate surface opposing said second lower arcuate surface when said first end of said jump cup is received in a corresponding one of said notches, said jump cup also having a second end that is configured to support an end of a pole.

11. A combination as recited in claim 10, wherein said first lower arcuate surface and said second lower arcuate surface define a radius of curvature in the range of 1.5 inches to 2.5 inches inclusive.

12. A combination as recited in claim 10, wherein said first lower arcuate surface and said second lower arcuate surface define a radius of curvature of 2 in.

13. A combination as recited in claim 10, wherein said base comprises plural triangular sections extending from a lower portion of said post.

14. A combination as recited in claim 10, wherein plural grooves are defined in a second side of said post that is opposite said first side of said post, and further comprising a bracket pivotally coupled to said jump cup and comprising a pair of levers extending in parallel to one another and a cross member connecting free ends of said levers to define an opening in said bracket, said cross member being configured to be received in one of said grooves when said first end of said jump cup is received in one of said notches.

15. A combination as recited in claim 14, wherein said bracket extends at an angle of 45° with respect to said first side of said post when said cross member is received in said one of said grooves and said first end of said jump cup is received in said one of said notches.

16. A combination as recited in claim 14, wherein said grooves are 2 inches high and 0.5 inches deep.

17. A combination as recited in claim 10, wherein said notches are 2 inches high and 2 inches deep.

18. A combination as recited in claim 10, wherein a cross-section of said post is 4 inches wide and 4 inches high.

* * * * *